US007959745B2

(12) United States Patent
Ishikawa et al.

(10) Patent No.: US 7,959,745 B2
(45) Date of Patent: Jun. 14, 2011

(54) HIGH-STRENGTH STEEL PIPE OF API X65 GRADE OR HIGHER

(75) Inventors: Nobuyuki Ishikawa, Fukuyama (JP); Toyohisa Shinmiya, Fukuyama (JP); Shigeru Endo, Fukuyama (JP); Minoru Suwa, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 263 days.

(21) Appl. No.: 11/434,047

(22) Filed: May 15, 2006

(65) Prior Publication Data

US 2006/0201592 A1 Sep. 14, 2006

Related U.S. Application Data

(63) Continuation of application No. 10/385,257, filed on Mar. 10, 2003, now abandoned, which is a continuation of application No. PCT/JP02/07102, filed on Jul. 12, 2002.

(30) Foreign Application Priority Data

Jul. 13, 2001 (JP) ..... 2001-213145
Nov. 29, 2001 (JP) ..... 2001-364103

(51) Int. Cl.
*C22C 38/14* (2006.01)
*C22C 38/12* (2006.01)
*C22C 38/24* (2006.01)
*C22C 38/28* (2006.01)

(52) U.S. Cl. ..... 148/328; 148/333; 148/334; 148/335; 148/336; 148/332; 148/909

(58) Field of Classification Search ..... 148/333–336, 148/320, 328, 332, 909, 590, 593, 602, 654; 420/123, 126, 127, 129, 110, 111
See application file for complete search history.

(56) References Cited

U.S. PATENT DOCUMENTS 5,948,183 A * 9/1999 Okada et al. ..... 148/330
(Continued)

FOREIGN PATENT DOCUMENTS

EP 0 733 715 A2 9/1996
(Continued)

OTHER PUBLICATIONS

Machine-English translation of Japanese patent 05-255745, Toyoda Kazuomi et al., May 5, 1993.*

*Primary Examiner* — Deborah Yee
(74) *Attorney, Agent, or Firm* — RatnerPrestia

(57) ABSTRACT

A high-strength steel pipe having a strength of API X65 grade or higher consisting essentially of, by mass %, 0.02 to 0.08% of C, 0.01 to 0.5% of Si, 0.5 to 1.8% of Mn, 0.01% or less of P, 0.002% or less of S, 0.01 to 0.7% of Al, 0.005 to 0.04% of Ti, 0.05 to 0.50% Mo, at least one element selected from 0.005 to 0.05% of Nb and 0.005 to 0.10% of V, and the balance being Fe, in which the volume percentage of the ferritic phase is 90% or higher, and complex carbides containing Ti, Mo, and at least one element selected from the group consisting of Nb and V are precipitated in the ferritic phase. The high-strength steel pipe has excellent HIC resistance and good toughness of a heat-affected zone, and can be manufactured stably at a low cost.

8 Claims, 3 Drawing Sheets

U.S. PATENT DOCUMENTS

| | | | | |
|---|---|---|---|---|
| 6,264,760 | B1 * | 7/2001 | Tamehiro et al. | 148/336 |
| 6,514,359 | B2 | 2/2003 | Kawano | |

FOREIGN PATENT DOCUMENTS

| | | | | |
|---|---|---|---|---|
| EP | 0 757 113 | A1 | | 2/1997 |
| EP | 0 792 379 | A1 | | 9/1997 |
| JP | 54-110119 | A | * | 8/1979 |
| JP | 61-60866 | A | * | 3/1986 |
| JP | 61-165207 | A | * | 7/1986 |
| JP | 361157628 | | * | 7/1986 |
| JP | 61-227129 | A | | 10/1986 |
| JP | 1-234521 | A | * | 9/1989 |
| JP | 4-168217 | A | * | 6/1992 |
| JP | 5-9575 | A | * | 1/1993 |
| JP | 5-271766 | A | | 10/1993 |
| JP | 7-70697 | A | | 3/1995 |
| JP | 7-173536 | A | | 7/1995 |
| JP | 7-216500 | A | | 8/1995 |
| JP | 09-49050 | | * | 2/1997 |
| JP | 10-30122 | A | * | 2/1998 |
| JP | 10-176239 | A | * | 6/1998 |

* cited by examiner

HIGH-STRENGTH STEEL PIPE OF API X65 GRADE OR HIGHER

CROSS-REFERENCE TO RELATED APPLICATIONS

This application is a continuation application of application Ser. No. 10/385,257 filed Mar. 10, 2003 now abandoned, which is a continuation application of International Application PCT/JP02/07102 (not published in English) filed Jul. 12, 2002.

BACKGROUND OF THE INVENTION

1. Field of the Invention

The present invention relates to a high-strength steel pipe having a strength of API X65 grade or higher which is used for line pipes, more particularly, a high-strength steel pipe having excellent hydrogen-induced cracking resistance (HIC resistance), and a manufacturing method thereof.

2. Description of Related Arts

A steel pipe for line pipes, which is used for transportation of crude oil or natural gas containing hydrogen sulfide, is required to have what we call sour resistance including HIC resistance and stress corrosion cracking resistance (SCC resistance) as well as high strength, excellent toughness, and good weldability. It is said that HIC is caused by an internal pressure that is produced by a phenomenon that hydrogen ions created by corrosion reaction are adsorbed on the steel surface, intrude into steel as atomic hydrogen, and accumulate around nonmetallic inclusions such as MnS and hard second phases such as martensite in steel.

To prevent HIC, Unexamined Japanese Patent Publication No. 54-110119 has disclosed a manufacturing method of linepipe steels, in which by adding Ca or Ce in proper amounts relative to the amount of S, and forming fine spherical inclusions to decrease stress concentration instead of formation of needle-like MnS inclusions. Unexamined Japanese Patent Publication No. 61-60866 and Unexamined Japanese Patent Publication No. 61-165207 have disclosed a steel in which the formation of island-like martensite that functions as an origin of cracking in a center segregation region and hard phases such as martensite or bainite that function as a propagation path of cracking is restrained by a decrease in amount of segregation-prone elements (C, Mn, P, etc.), soaking treatment at a stage of slab heating, accelerated cooling during transformation at a stage of cooling, etc. Unexamined Japanese Patent Publication No. 5-9575, Unexamined Japanese Patent Publication No. 5-271766, and Unexamined Japanese Patent Publication No. 7-173536 have disclosed a steel plate having a strength of API X80 grade or higher, in which the shape of inclusions is controlled by adding Ca to a low-S steel, center segregation is restrained by lower contents of C and Mn, and high strength is provided by the addition of Cr, Mn and Ni and accelerated cooling. All of these methods for preventing HIC are methods for preventing HIC caused by center segregation.

However, a steel plate having a strength of API X65 grade or higher is usually manufactured by accelerated cooling or direct quenching, so that a near surface region of the steel plate which receives high cooling rate is more liable to be hardened than the interior thereof, and hence HIC occurs easily in the near surface region. Also, microstructure obtained by accelerated cooling consists of bainite and acicular ferrite having relatively high HIC sensitivity not only in the near surface region but also in the interior, so that the above-described method for preventing HIC caused by center segregation does not suffice. Therefore, in order to prevent HIC of steel plate completely, measures must be taken against HIC caused by the microstructure of the near surface region of steel plate and HIC caused by inclusions such as sulfide or oxide as well as HIC caused by center segregation.

On the other hand, Unexamined Japanese Patent Publication No. 7-216500 has disclosed an API X80 grade HIC-resistant steel that is composed of ferrite and bainite phases and does not contain block-like bainite or martensite phases with high HIC sensitivity. Unexamined Japanese Patent Publication No. 61-227129 and Unexamined Japanese Patent Publication No. 7-70697 have disclosed high-strength steels in which SCC resistance and HIC resistance are improved by ferritic microstructure and Mo or Ti is added to utilize precipitation strengthening by carbides.

However, the microstructure of the high-strength steel described in Unexamined Japanese Patent Publication No. 7-216500 consists of bainite phases with relatively high HIC sensitivity. Also, this steel is high in manufacturing cost because the content of S and Mn is restricted severely and Ca treatment is necessary. The microstructure of the high-strength steels described in Unexamined Japanese Patent Publication No. 61-227129 and Unexamined Japanese Patent Publication No. 7-70697 consists of ductile ferritic phases, so that the HIC sensitivity is very low, while the strength is low. In order to obtain higher strength for the steel described in Unexamined Japanese Patent Publication No. 61-227129, large amounts of C and Mo are added, cold-rolling is performed after quench-and-temper, and tempering is performed again to precipitate a large amount of carbides, resulting in increased manufacturing cost. The steel described in Unexamined Japanese Patent Publication No. 7-70697 cannot achieve high strength stably because Ti is added to obtain high strength by utilizing precipitation strengthening of TiC at a stage of coiling, but TiC is liable to be coarsened by the influence of coiling temperature. Although high strength can be achieved stably by adding large amount of Ti, the toughness of heat-affected zone deteriorates significantly when the welding such as electric resistance welding or submerged arc welding are applied.

SUMMARY OF THE INVENTION

An object of the present invention is to provide a high-strength steel pipe of API X65 grade or higher which has excellent HIC resistance and good toughness after welding, and which can be manufactured stably at a low cost, and a manufacturing method thereof.

The above object can be attained by a high-strength steel pipe of API X65 grade or higher consisting essentially of, by mass %, 0.02 to 0.08% of C, 0.01 to 0.5% of Si, 0.5 to 1.8% of Mn, 0.01% or less of P, 0.002% or less of S, 0.01 to 0.07% of Al, 0.005 to 0.04% of Ti, 0.05 to 0.50% Mo, at least one element selected from 0.005 to 0.05% of Nb and 0.005 to 0.10% of V, and the balance being Fe, in which the volume percentage of ferritic phase is 90% or higher, and complex carbides containing Ti, Mo, and at least one element selected from Nb and V are precipitated in the ferritic phase.

This high-strength steel pipe is manufactured, for example, by a manufacturing method for a high-strength steel pipe of API X65 grade or higher, comprising the steps of heating a steel slab having chemical composition described above to a temperature in the range of 1000 to 1250° C.; hot rolling the steel slab at a finish temperature not lower than the Ar3-transformation temperature to make a steel plate; cooling the steel plate at a cooling rate not lower than 2° C./s; coiling the cooled steel plate at a temperature in the range of 550 to 700° C.; and forming the coiled steel plate into a steel pipe.

DETAILED DESCRIPTION OF THE INVENTION

Figure 1:
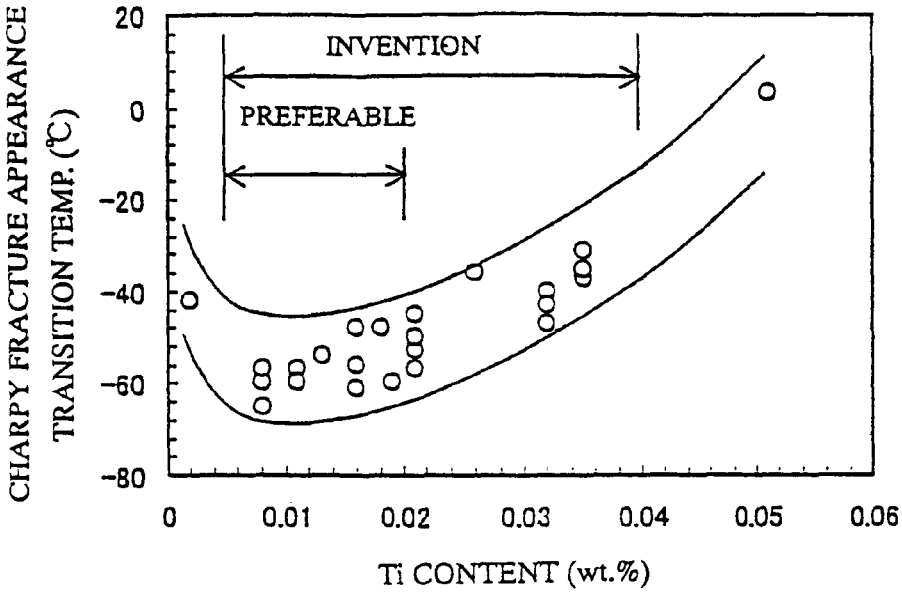
FIG. 1 is a diagram showing the relationship between Ti content and Charpy fracture appearance transition temperature of heat-affected zone.

The inventors obtained the following findings as a result of study on HIC resistance and toughness of welded part of a high-strength steel pipe having a strength of API X65 grade or higher which is used for line pipes.

1) If hard second phases such as bainite, martensite, pearlite, etc. exist in a ferritic phase, accumulation of hydrogen and stress concentration are prone to occur at the phase interface, so that a volume percentage of ferritic phase not lower than 90% is effective in improving HIC resistance.

2) It is well known that Mo and Ti are elements forming carbides in steel, and the steel is strengthened by precipitation of MoC or TiC. Carbides precipitated in a ferritic phase by co-addition of Mo and Ti are represented by (Mo, Ti)C, and these carbides are complex carbides in which (Mo, Ti) and C are bonded to each other at an atom ratio of about 1:1. The carbides are very fine, smaller than 10 nm, because they are stable and have a low growth rate. Therefore, these complex carbides have a more powerful strengthening function than the conventional MoC and TiC. Such very fine carbides exert no influence on HIC.

3) In the steels containing Ti, as the Ti content increases, the toughness of heat-affected zone deteriorates. To prevent this deterioration, it is effective to add at least one element selected from Nb and V in addition to Mo and Ti and to precipitate fine complex carbides containing Mo, Ti, Nb and/or V.

4) By the above-described microstructure, both a high strength of API X65 grade or higher and HIC resistance such that cracking does not occur in a HIC test in accordance with NACE Standard TM-02-84 can be achieved. In particular, both a high strength of API X70 grade or higher and excellent HIC resistance can be achieved for the first time by the present invention.

The present invention has been made based on the above findings. The reason for limiting the content of each element will be described below.

C: C is an element for strengthening steel by precipitation as carbides. However, if the C content is lower than 0.02%, a strength of API X65 grade or higher cannot be obtained, and if it exceeds 0.08%, the HIC resistance and the toughness of welded part deteriorate. Therefore, the C content should be 0.02 to 0.08%.

Si: Si is an element necessary for deoxidization of steel. However, if the Si content is lower than 0.01%, the deoxidization effect is insufficient, and if it exceeds 0.5%, the weldability and the toughness deteriorate. Therefore, the Si content should be 0.01 to 0.5%.

Mn: Mn is an element for strengthening steel and improving the toughness. However, if the Mn content is lower than 0.5%, its effect is insufficient, and if it exceeds 1.8%, the weldability and the HIC resistance deteriorate. Therefore, the Mn content should be 0.5 to 1.8%.

P: P is an element that deteriorates the weldability and the HIC resistance. Therefore, the P content should be not higher than 0.01%.

S: S turns to MnS inclusion in steel and hence deteriorates the HIC resistance. Therefore, the S content should not be higher than 0.002%.

Al: Al is added as a deoxidizer. If the Al content is lower than 0.01%, the deoxidization effect is not achieved, and if it exceeds 0.07%, the cleanliness of steel degrades and thus the HIC resistance deteriorates. Therefore, the Al content should be 0.01 to 0.07%.

Ti: Ti is an important element in the present invention. If the Ti content is not lower than 0.005%, Ti forms complex carbides together with Mo as described above, so that strengthening of steel is promoted. However, as shown in FIG. 1, if the Ti content exceeds 0.04%, the Charpy fracture appearance transition temperature of heat-affected zone exceeds −20°, and hence the toughness deteriorates. Therefore, the Ti content should be 0.005 to 0.04%. Further, if the Ti content is lower than 0.02%, the Charpy fracture appearance transition temperature of heat-affected zone is not higher than −40°, and hence higher toughness is obtained. Therefore, the Ti content should preferably be 0.005 to less than 0.02%.

Mo: As described above, Mo is an important element in the present invention, like Ti. If the Mo content is not lower than 0.05%, pearlite transformation is restrained at a stage of cooling after hot rolling, and fine complex carbides are formed together with Ti so that the strengthening of steel is promoted. However, if the Mo content exceeds 0.50%, hard phases such as bainite or martensite are formed, and hence the HIC resistance deteriorates. Therefore, the Mo content should be, 0.05 to 0.50%.

Nb: Nb improves the toughness by microstructure refining, and forms complex carbides together with Ti and Mo, contributing to the strengthening of steel. However, if the Nb content is lower than 0.005%, its effect is not achieved, and if it exceeds 0.05%, the toughness of heat-affected zone deteriorates. Therefore, the Nb content should be 0.005 to 0.05%.

V: V forms complex carbides together with Ti and Mo, like Nb, contributing to the strengthening of steel. However, if the V content is lower than 0.005%, its effect is not achieved, and if it exceeds 0.1%, the toughness of welded part deteriorates. Therefore, the Nb content should be 0.0.005 to 0.1%.

If at least one element selected from Nb and V is contained, the strengthening and improvement in toughness of heat-affected zone are achieved.

The balance other than the above-described components is Fe. Also, other elements such as unavoidable impurities may be contained as far as these elements exert no influence on the operation and effects of the present invention.

If the ratio of the number of complex carbides smaller than 10 nm and containing Mo and Ti to the number of all the precipitates excluding TiN, which contributes less to the strengthening of steel, is not smaller than 80%, preferably not smaller than 95%, the strengthening of steel can be promoted.

Figure 2:
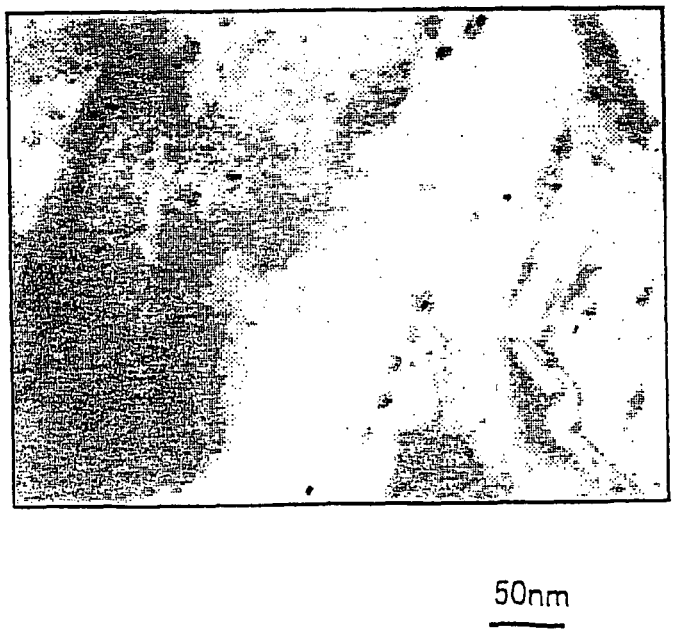
FIG. 2 is a view showing one example of microstructure of a high-strength steel in accordance with the present invention.
Figure 3:
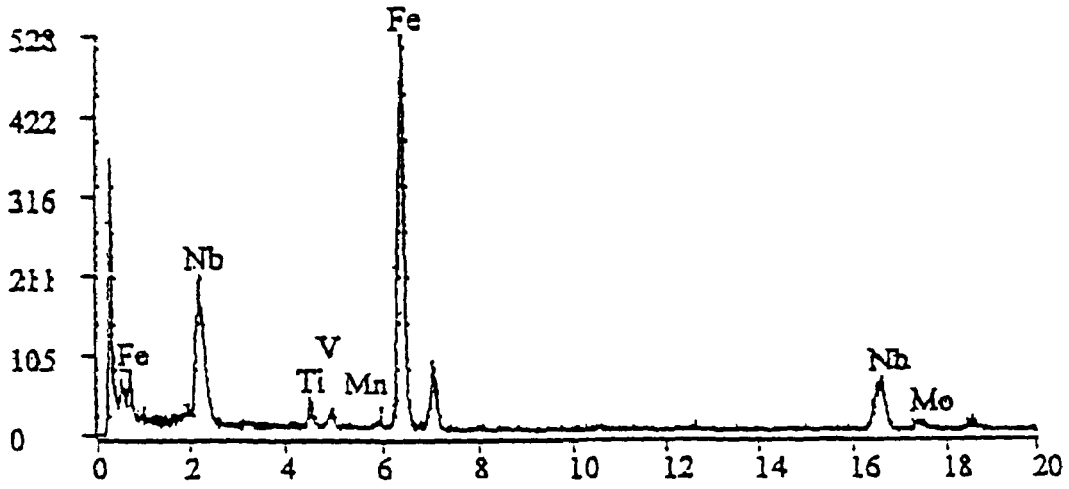
FIG. 3 is a diagram showing an EDX analysis result of precipitates.

FIG. 2 shows one example of a microstructure of the steel in accordance with the present invention, which is manufactured in a hot rolling mill for steel sheet (coiling temperature: 650° C.) using a steel having composition of 0.05% C, 0.15% Si, 1.26% Mn, 0.11% Mo, 0.018% Ti, 0.039% Nb, and 0.048% V. It can be verified that many fine precipitates smaller than 10 nm in size are dispersed. Also, FIG. 3 shows a result of analysis of precipitates made by an energy dispersion X-ray spectroscopy method (EDX). It can be seen that the precipitates are complex carbides containing Ti, Nb, V and Mo.

Further, W is added in place of Mo or together with Mo so that the content of (W/2+Mo) is in the range of 0.05 to 0.50%. In this case as well, fine complex carbides are formed together with Ti, and hence the strengthening of steel is promoted. If the content of (W/2+Mo) exceeds 0.50%, hard phases such as bainite or martensite are formed, deteriorating the HIC resistance.

Further, if Ca is added, the shape of sulfide inclusions is controlled, and hence the HIC resistance is improved. However, if the Ca content is lower than 0.0005%, its effect is insufficient, and if it exceeds 0.0040%, the cleanliness of steel degrades and thus the HIC resistance deteriorates. Therefore, the Ca content should be 0.0005 to 0.0040%.

Still further, if at least one element selected from Cu, Ni and Cr is contained in an amount described below, further strengthening of steel can be achieved.

Cu: Cu is an effective element for improving the toughness and increasing the strength. However, if the Cu content exceeds 0.5%, the weldability deteriorates. Therefore, the Cu content should be not higher than 0.5%.

Ni: Ni is an effective element for improving the toughness and increasing the strength. However, if the Ni content exceeds 0.5%, the HIC resistance deteriorates. Therefore, the Ni content should be not higher than 0.5%.

Cr: Cr is an effective element for increasing the strength, like Mn. However, if the Cr content exceeds 0.5%, the weldability deteriorates. Therefore, the Cr content should be not higher than 0.5%.

If not only the content of each component but also Ceq expressed by the following equation (1) is controlled, the toughness of heat-affected zone is further improved. In particular, it is preferable that Ceq be not higher than 0.30% for API X65 grade, Ceq be not higher than 0.32% for API X70 grade, and Ceq be not higher than 0.34% for API X80 grade.

$$Ceq=C+Mn/6+(Cu+Ni)/15+(Cr+Mo+V)/5 \quad (1)$$

Further, if R expressed by the following equation (2) is in the range of 0.5 to 3.0, thermally stable and very fine complex carbides can be obtained, so that strengthening of steel and improvement in toughness of heat-affected zone can be achieved more stably. In order to obtain a far higher strength, the R should preferably be 0.7 to 2.0.

$$R=(C/12)/[(Mo/96)+(Ti/48)+(Nb/93)+(V/51)+(W/184)] \quad (2)$$

Next, a manufacturing method for the high-strength steel pipe in accordance with the present invention will be described.

A steel slab having the above-described composition is heated to a temperature in the range of 1000 to 1250° C., and is hot rolled at a finish temperature not lower than the Ar3 transformation temperature. Then the rolled plate is cooled at a cooling rate not lower than 2° C./s and is coiled at a temperature in the range of 550 to 700° C., and finally, a steel pipe is formed. Thereby, a high-strength steel pipe of API X65 grade or higher which is composed of ferritic phase with a volume percentage not lower than 90% and complex carbides containing Ti, Mo, and at least one element selected from Nb and V which are dispersed in the ferritic phase can be obtained.

If the heating temperature of slab is lower than 1000° C., the carbides are not resolved sufficiently, so that a necessary strength cannot be obtained, and if the heating temperature exceeds 1250° C., the toughness deteriorates. Therefore, the heating temperature of slab should be 1000 to 1250° C.

If hot rolling is performed at a finish temperature lower than the Ar3 transformation temperature, the microstructure becomes elongated in the rolling direction, and hence the HIC resistance deteriorates. Therefore, hot rolling should be performed at a finish temperature not lower than the Ar3 transformation temperature. To prevent a decrease in toughness due to coarse microstructure, hot rolling should preferably be performed at a finish temperature not higher than 950° C.

After hot rolling, if the rolled plate is cooled at a cooling rate lower than 2° C./s as in the case of air cooling or slow cooling, complex carbides begin to precipitate at a high temperature region and coarsen easily, which inhibits the strengthening of steel. For this reason, the rolled plate must be cooled at a cooling rate not lower than 2° C./s. At this time, if the cooling finish temperature is too high, the precipitates are coarsened, so that a sufficient strength is not obtained. Therefore, the cooling finish temperature should preferably be not lower than the coiling temperature and not higher than 750° C.

After being cooled at a cooling rate not lower than 2° C./s, the steel plate must be coiled at a temperature in the range of 550 to 700° C., preferably in the range of 600 to 660° C., to obtain ferritic phase and fine complex carbides. If the coiling temperature is lower than 550° C., bainitic phase is formed, and hence the HIC resistance deteriorates. If the coiling temperature exceeds 700° C., the complex carbides coarsen, and hence a sufficient strength cannot be obtained.

This coiling method for coiling the steel plate at a temperature in the range of 550 to 700° C. is used when a steel plate which is a raw material for a steel pipe is manufactured in a hot rolling mill for steel sheet. In this case, the steel plate is formed into an electric resistance welded steel pipe or a spiral steel pipe by the press bent forming method or the roll forming method.

When a steel plate which is a raw material for a steel pipe is manufactured in a hot rolling mill for heavy gauge steel plate, instead of being coiled at a temperature in the range of 550 to 700° C., it is necessary that the steel plate be cooled to a temperature in the range of 600 to 700° C. at a cooling rate not lower than 2° C./s, and then it be slowly cooled at least to 550° C. at a cooling rate not higher than 0.1° C./s, or the steel plate be cooled to a temperature in the range of 550 to 700° C., and immediately after that, it be subjected to heat treatment at temperatures in the range of 550 to 700° C. for three minutes or longer. In this case, the steel plate is formed into a UOE steel pipe by the UOE forming method.

As means for slowly cooling the steel plate at a cooling rate not higher than 0.1° C./s, there can be used a method in which steel plates are piled and cooled or a method in which the steel plate is cooled in a box furnace etc.

If an induction heating apparatus is provided on a plate manufacturing line, the heat treatment at temperatures in the range of 550 to 700° C. for three minutes or longer can be accomplished without a decrease in the temperature of steel plate to below 550° C., which does not result in decreased productivity.

Figure 4:
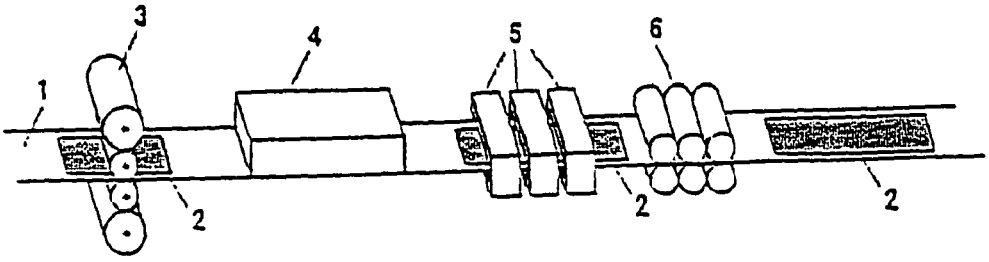
FIG. 4 is a view showing one example of a production line for a steel plate.

FIG. 4 shows one example of an equipment layout on a plate manufacturing line.

On the manufacturing line 1, a hot rolling mill 3, an accelerated cooling apparatus 4, an induction heating apparatus 5 and a hot leveler 6 are arranged in order from the upstream side to the downstream side. After a slab coming out of a heating furnace is rolled into a steel plate 2 by the hot rolling mill 3, the steel plate 2 is cooled by the accelerated cooling apparatus 4, and is subjected to heat treatment by the induction heating apparatus 5. Then, the steel plate 2 is corrected in shape by the hot leveler 6, and is sent to a pipe manufacturing process.

Figure 5:
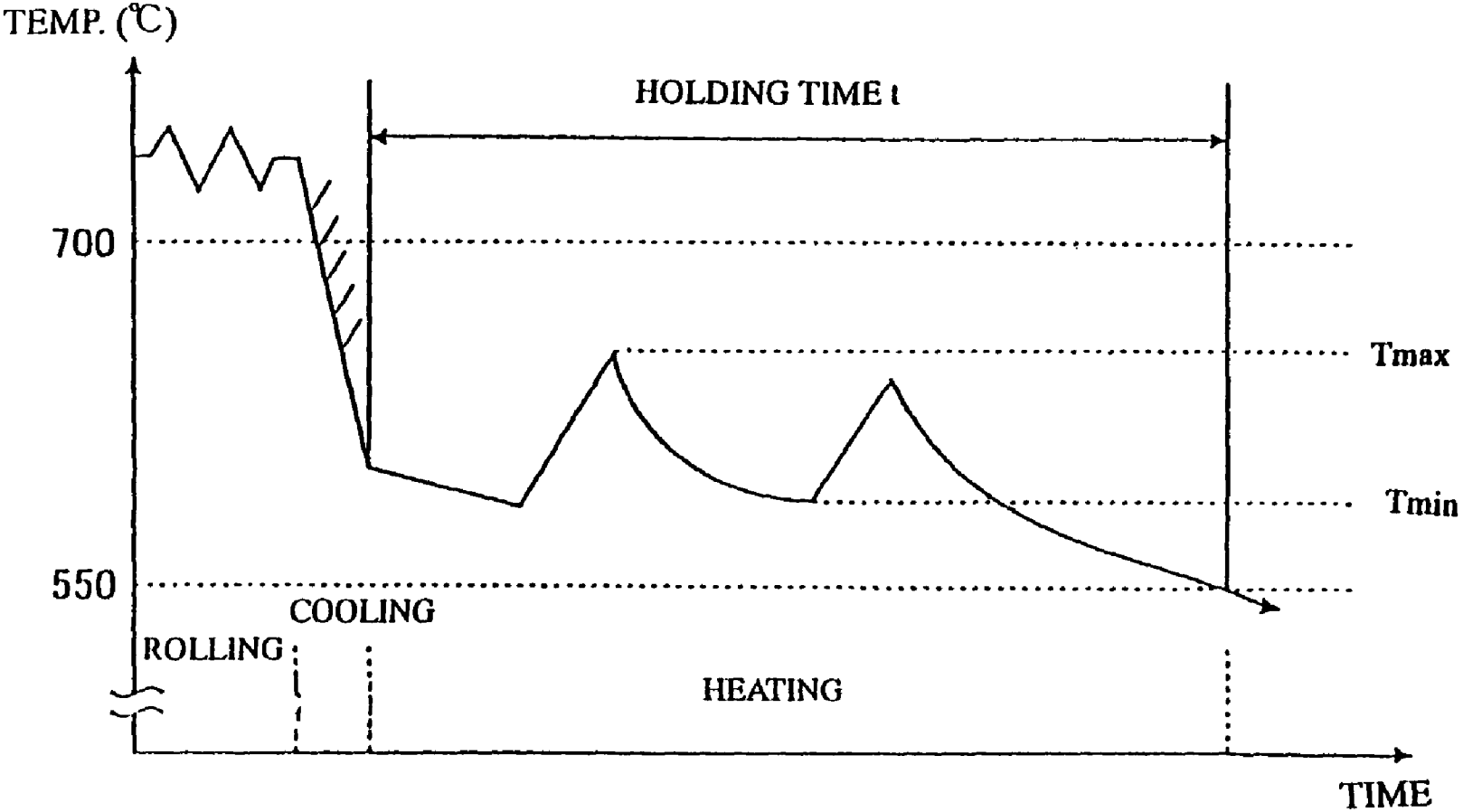
FIG. 5 is a graph showing one example of heat treatment using an induction heating apparatus.

FIG. 5 shows one example of heat treatment using the induction heating apparatus.

In this example, the steel plate is kept at temperatures in the range of 550 to 700° C. by performing two cycles of heating using the induction heating apparatus. The induction heating apparatus is turned on and off so that the highest temperature (Tmax) does not exceed 700° C. and the lowest temperature (Tmin) is not lower than 550° C., by which the steel plate is kept at temperatures in the range of 550 to 700° C. for three minutes or longer in total. The induction heating arises a difference in temperature between the surface layer and the interior of steel plate. The temperature specified herein is an average plate temperature when heat transfers from the surface layer to the interior and becomes even.

Example 1

Electric resistance welded steel pipes Nos. 1 to 29 with an outside diameter of 508.0 mm and a wall thickness of 12.7 mm were manufactured, using the steels A to O having chemical composition given in Table 1 and hot rolled under conditions given in Table 2 in a hot rolling mill for steel sheet. Also, UOE steel pipes Nos. 30 to 35 with an outside diameter of 914.4 mm and a wall thickness of 19.1 mm and with an outside diameter of 1219.2 mm and a wall thickness of 25.4 mm were manufactured, using steel plates which were produced under conditions given in Table 3 in a hot rolling mill for steel plate. The steel plates were piled and slowly cooled to room temperature from a certain temperature. The mean cooling rate from the start of slow cooling to 550° C. is additionally shown in Table 3. Also, the UOE steel pipes given in Table 3 were expanded by 1.2% after they were seam welded by submerged arc welding.

The microstructure of steel pipe was observed using an optical microscope and a transmission electron microscope (TEM). The composition of precipitates was analyzed by an energy dispersion X-ray spectroscopy method (EDX).

Also, a full-thickness tensile test piece in accordance with API standard was cut out in the circumference direction to conduct a tensile test, by which yield strength and tensile strength were measured. Considering variations due to manufacturing conditions, the steel pipe having a tensile strength not lower than 550 MPa was regarded as meeting the standard of API X65 grade, the steel pipe having a tensile strength not lower than 590 MPa was regarded as meeting the standard of API X70 grade, and the steel pipe having a tensile strength not lower than 680 MPa was regarded as meeting the standard of API X80 grade.

Further, HIC resistance and toughness of heat-affected zone (HAZ) were measured. For HIC resistance, a HIC test of dipping time of 96 hours in accordance with NACE Standard TM-02-84 was conducted, and the case where cracking was not recognized was indicated by ○, and the case where cracking occurred was indicated by ○. For HAZ toughness, a 2-mm V notch Charpy test piece was taken in the circumference direction in the electric resistance welded portion or the seam welded portion to measure fracture appearance transition temperature (vTrs). At this time, the V notch was formed in the center of electric resistance welded portion for steel pipes Nos. 1 to 29 and in the bond portion (fusion line) at the position of t/2 (t is plate thickness) for steel pipes Nos. 30 to 35.

The test results are given in Tables 2 and 3.

All of steel pipes Nos. 1 to 18 in accordance with the present invention were of X65 grade or higher, and had excellent HIC resistance and HAZ toughness. The microstructure of those steel pipes was substantially a ferritic phase, in which fine carbides with a particle diameter smaller than 10 nm which contained Ti, Mo, and at least one element selected from Nb and V were dispersed. Steel pipes Nos. 3, 4, 5, 10, 11, 12, 17 and 18 using B, C, F and I steels in which the Ti content is lower than 0.005 to 0.02% exhibited higher HAZ toughness. Also, steel pipes Nos. 1 to 15 using A to G steels in which the ratio of the C content to the total content of Mo, Ti, Nb, V and W was in the range of 0.7 to 2.0 had a higher strength than steel pipes Nos. 16 to 18 using H and I steels.

For steel pipes Nos. 19 to 23 as comparative examples, the microstructure thereof was not substantially a ferritic phase because the manufacturing method was outside the range of the present invention, and fine carbides containing Ti, Mo, and at least one element selected from Nb and V were not precipitated, so that a sufficient strength was not obtained and cracking was observed in the HIC test. For steel pipe No. 19, a sufficient amount of solute carbon could not be secured because of low heating temperature, and a sufficient strength could not be obtained because of lack in carbides precipitated at the coiling time. For steel pipe No. 20, since the rolling finish temperature was low, the microstructure became elongated in the rolling direction, and hence the HIC resistance deteriorated. For steel pipe No. 21, since the cooling rate after rolling was low, carbides began to precipitate from a high temperature region and were coarsened, so that the strength was decreased. For steel pipe No. 22, since the coiling temperature was high, carbides were coarsened, so that a sufficient strength was not obtained. For steel pipe No. 23, since the coiling temperature was low, the structure contained bainitic phase, so that the HIC resistance deteriorated.

Also, steel pipes Nos. 24 to 29 as comparative examples had problems of insufficient strength, occurrence of cracking in HIC test, and deteriorated HAZ toughness because the chemical composition was outside the range of the present invention. For steel pipes Nos. 24 and 25, since the content of Mo or Ti was low, sufficient precipitation strengthening was not achieved, so that the strength was low. For steel pipe No. 26, since the Ti content was too high, the microstructure was coarsened by welding heat, so that the HAZ toughness deteriorated. For steel pipe No. 27, since the C content was low, sufficient precipitation strengthening was not achieved, so that the strength was low. For steel pipe No. 28, since the C content was too high, bainitic phase was formed, and hence the HIC resistance deteriorated. For steel pipe No. 29, since the S content was too high, many sulfide inclusions were formed, so that the HIC resistance deteriorated.

All of steel pipes Nos. 30 to 33 in accordance with the present invention had a tensile strength of 580 MPa or higher, and also had high HIC resistance and HAZ toughness. The structure of steel pipe was substantially a ferritic phase, in which fine carbides with a particle diameter smaller than 10 nm which contained Ti, Mo, and at least one element selected from Nb and V were dispersed.

For steel pipe No. 34 as comparative examples, since the cooling rate was high at the time of slow cooling, and the microstructure contained bainitic phase, the HIC resistance deteriorated. Also, for steel pipe No. 35, since the chemical composition was outside the range of the present invention and the Ti content was high, the HAZ toughness deteriorated.

TABLE 1

| Steel type | C | Si | Mn | P | S | Mo | Ti | Nb | V | Al | Cu | Ni | Cr | Ca | W | Ceq | C/(Mo + Ti + Nb + V + Zr)* | Remarks |
|---|---|---|---|---|---|---|---|---|---|---|---|---|---|---|---|---|---|---|
| A | 0.045 | 0.18 | 1.15 | 0.008 | 0.0008 | 0.13 | 0.022 | 0.046 | | 0.032 | | | | | | 0.26 | 1.62 | Example |
| B | 0.053 | 0.25 | 1.23 | 0.005 | 0.0004 | 0.21 | 0.016 | | 0.069 | 0.041 | | | | | | 0.31 | 1.14 | |
| C | 0.051 | 0.15 | 1.26 | 0.008 | 0.0007 | 0.11 | 0.018 | 0.039 | 0.048 | 0.042 | | | | | | 0.29 | 1.47 | |
| D | 0.061 | 0.30 | 1.16 | 0.010 | 0.0009 | 0.32 | 0.034 | 0.028 | | 0.025 | | | | | | 0.32 | 1.17 | |
| E | 0.042 | 0.26 | 1.09 | 0.009 | 0.0013 | 0.14 | 0.028 | | 0.052 | 0.030 | 0.12 | 0.18 | | 0.0015 | 0.18 | 0.28 | 0.86 | |
| F | 0.047 | 0.14 | 1.20 | 0.002 | 0.0008 | 0.12 | 0.013 | 0.038 | 0.048 | 0.034 | | | 0.12 | 0.0021 | | 0.30 | 1.36 | |
| G | 0.050 | 0.21 | 1.25 | 0.007 | 0.0010 | 0.28 | 0.035 | 0.021 | 0.028 | 0.032 | | | | 0.0023 | | 0.32 | 0.94 | |
| H | 0.032 | 0.25 | 1.06 | 0.008 | 0.0012 | 0.24 | 0.022 | 0.030 | 0.035 | 0.022 | | | | 0.0015 | | 0.26 | 0.67 | |
| I | 0.060 | 0.30 | 1.22 | 0.005 | 0.0009 | 0.06 | 0.008 | 0.028 | 0.035 | 0.025 | | | | 0.0032 | | 0.28 | 2.80 | |
| J | 0.055 | 0.23 | 1.24 | 0.006 | 0.0010 | 0.02 | 0.019 | 0.032 | 0.023 | 0.033 | | | | | | 0.27 | 3.27 | Compara- |
| K | 0.047 | 0.32 | 1.33 | 0.008 | 0.0013 | 0.14 | 0.002 | 0.048 | 0.041 | 0.026 | | | | | | 0.30 | 1.39 | tive |
| L | 0.049 | 0.22 | 1.58 | 0.011 | 0.0015 | 0.16 | 0.051 | 0.009 | 0.045 | 0.027 | | | | | | 0.35 | 1.10 | example |
| M | 0.012 | 0.17 | 1.16 | 0.005 | 0.0008 | 0.23 | 0.008 | | 0.034 | 0.034 | 0.24 | 0.31 | | | | 0.29 | 0.31 | |
| N | 0.093 | 0.29 | 1.15 | 0.003 | 0.0009 | 0.12 | 0.008 | 0.030 | 0.052 | 0.039 | | | | 0.0024 | | 0.32 | 2.80 | |
| O | 0.050 | 0.28 | 1.36 | 0.004 | 0.0023 | 0.21 | 0.013 | 0.028 | 0.048 | 0.025 | 0.16 | 0.22 | | 0.0018 | | 0.35 | 1.12 | |

Unit: mass %, *: at %

Underline indicates outside the range of this invention

TABLE 2

| No. | Steel type | Outside diameter (mm) | Wall thick-ness (mm) | Heating temp. (° C.) | Rolling finish temp. (° C.) | Cooling rate (after rolling) (° C./s) | Treatment method after cooling | Coiling temp. (° C.) | Yield strength (MPa) | Tensile strength (MPa) | Grade | HIC resis-tance | Tough-ness of welded part vTrs (° C.) | Remarks |
|---|---|---|---|---|---|---|---|---|---|---|---|---|---|---|
| 1 | A | 508.0 | 12.7 | 1150 | 910 | 20 | Coiling | 650 | 505 | 587 | X65 | ○ | −50 | Example |
| 2 | A | 508.0 | 12.7 | 1150 | 870 | 20 | Coiling | 620 | 502 | 592 | X65 | ○ | −45 | |
| 3 | B | 508.0 | 12.7 | 1200 | 900 | 20 | Coiling | 635 | 552 | 642 | X70 | ○ | −57 | |
| 4 | C | 508.0 | 12.7 | 1200 | 900 | 20 | Coiling | 650 | 558 | 658 | X70 | ○ | −64 | |
| 5 | C | 508.0 | 12.7 | 1200 | 900 | 20 | Coiling | 615 | 542 | 635 | X70 | ○ | −60 | |
| 6 | D | 508.0 | 12.7 | 1200 | 880 | 20 | Coiling | 590 | 588 | 706 | X80 | ○ | −47 | |
| 7 | D | 508.0 | 12.7 | 1150 | 880 | 20 | Coiling | 620 | 608 | 726 | X80 | ○ | −40 | |
| 8 | D | 508.0 | 12.7 | 1150 | 880 | 20 | Coiling | 680 | 608 | 713 | X80 | ○ | −43 | |
| 9 | E | 508.0 | 12.7 | 1150 | 880 | 20 | Coiling | 635 | 548 | 638 | X70 | ○ | −48 | |
| 10 | F | 508.0 | 12.7 | 1200 | 900 | 20 | Coiling | 665 | 578 | 669 | X70 | ○ | −65 | |
| 11 | F | 508.0 | 12.7 | 1200 | 900 | 8 | Coiling | 650 | 548 | 652 | X70 | ○ | −62 | |
| 12 | F | 508.0 | 12.7 | 1150 | 900 | 20 | Coiling | 650 | 570 | 665 | X70 | ○ | −72 | |
| 13 | G | 508.0 | 12.7 | 1150 | 880 | 20 | Coiling | 635 | 630 | 738 | X80 | ○ | −31 | |
| 14 | G | 508.0 | 12.7 | 1150 | 880 | 20 | Coiling | 600 | 614 | 726 | X80 | ○ | −37 | |
| 15 | G | 508.0 | 12.7 | 1050 | 870 | 8 | Coiling | 600 | 591 | 682 | X80 | ○ | −35 | |
| 16 | H | 508.0 | 12.7 | 1150 | 870 | 20 | Coiling | 630 | 481 | 556 | X65 | ○ | −27 | |
| 17 | I | 508.0 | 12.7 | 1050 | 870 | 20 | Coiling | 640 | 458 | 551 | X65 | ○ | −60 | |
| 18 | I | 508.0 | 12.7 | 1200 | 800 | 20 | Coiling | 620 | 473 | 553 | X65 | ○ | −57 | |
| 19 | A | 508.0 | 12.7 | 950 | 740 | 20 | Coiling | 585 | 415 | 512 | X52 | X | −53 | Compara- |
| 20 | A | 508.0 | 12.7 | 1200 | 730 | 20 | Coiling | 625 | 483 | 564 | X65 | X | −57 | tive |
| 21 | A | 508.0 | 12.7 | 1200 | 910 | 1 | Coiling | 630 | 446 | 520 | X52 | ○ | −50 | example |
| 22 | A | 508.0 | 12.7 | 1200 | 910 | 20 | Coiling | 725 | 392 | 458 | X52 | ○ | −45 | |
| 23 | B | 508.0 | 12.7 | 1150 | 880 | 20 | Coiling | 520 | 538 | 633 | X70 | X | −60 | |
| 24 | J | 508.0 | 12.7 | 1150 | 900 | 20 | Coiling | 650 | 419 | 483 | X52 | ○ | −60 | |
| 25 | K | 508.0 | 12.7 | 1150 | 900 | 20 | Coiling | 635 | 416 | 483 | X52 | ○ | −33 | |
| 26 | L | 508.0 | 12.7 | 1150 | 900 | 20 | Coiling | 640 | 630 | 736 | X80 | ○ | 3 | |
| 27 | M | 508.0 | 12.7 | 1150 | 900 | 20 | Coiling | 640 | 395 | 462 | X52 | ○ | −65 | |
| 28 | N | 508.0 | 12.7 | 1200 | 900 | 20 | Coiling | 635 | 540 | 625 | X70 | X | −27 | |
| 29 | O | 508.0 | 12.7 | 1200 | 900 | 20 | Coiling | 635 | 537 | 658 | X70 | X | −40 | |

Underline indicates outside the range of this invention

TABLE 3

| No. | Steel type | Outside diameter (mm) | Wall thickness (mm) | Heating temp. (° C.) | Rolling finish temp. (° C.) | Cooling rate (after rolling) (° C./s) | Cooling stop temp. (° C.) | Treatment method after cooling |
|---|---|---|---|---|---|---|---|---|
| 30 | A | 1219.2 | 25.4 | 1150 | 900 | 22 | 640 | Slow cooling |
| 31 | F | 914.4 | 19.1 | 1150 | 880 | 30 | 660 | Slow cooling |
| 32 | F | 1219.2 | 25.4 | 1200 | 900 | 22 | 655 | Slow cooling |
| 33 | G | 1219.2 | 25.4 | 1200 | 900 | 22 | 670 | Slow cooling |

TABLE 3-continued

| | | | | | | | | |
|---|---|---|---|---|---|---|---|---|
| 34 | D | 1219.2 | 25.4 | 1200 | 900 | 22 | 635 | Slow cooling |
| 35 | L | 914.4 | 19.1 | 1200 | 900 | 30 | 650 | Slow cooling |

| No. | Cooling rate (at the slow cooling) (° C./s) | Yield strength (MPa) | Tensile strength (MPa) | Grade | HIC resistance | Toughness of welded part vTrs (° C.) | Remarks |
|---|---|---|---|---|---|---|---|
| 30 | 0.04 | 485 | 596 | X65 | ○ | −45 | Example |
| 31 | 0.08 | 520 | 650 | X70 | ○ | −48 | |
| 32 | 0.04 | 542 | 663 | X70 | ○ | −55 | |
| 33 | 0.04 | 585 | 710 | X80 | ○ | −42 | |
| 34 | 1 | 448 | 537 | X65 | X | −58 | Comparative example |
| 35 | 0.08 | 574 | 706 | X80 | ○ | 2 | |

Underline indicates outside the range of this invention

Example 2

Steel plates were manufactured under the conditions given in Table 5 in a hot rolling mill for a steel plate by making slabs from steels a to i having chemical composition given in Table 4 by the continuous casting method. After being hot rolled, the rolled steel plates were immediately cooled by using a water-cooled inline accelerated cooling apparatus, and were subjected to heat treatment by using three inline induction heating apparatuses provided in series on the manufacturing line or a gas-fired furnace. In Table 5, each temperature is an average plate temperature, and the maximum and minimum temperatures are the above-described highest and lowest temperatures at the time of heat treatment. Also, the number of cycles means the number of cycles of heating performed by using the induction heating apparatuses to keep the steel plate at temperatures in the range of 550 to 700° C. for three minutes or longer. In the case of gas firing, the steel plate was kept at a fixed temperature.

As in example 1, UOE steel pipes Nos. 36 to 51 with an outside diameter of 914.4 mm and a wall thickness of 19.1 mm and with an outside diameter of 1219.2 mm and a wall thickness of 25.4 mm were manufactured, and the microstructure, yield strength, tensile strength, HIC resistance, and HAZ toughness were measured.

The measurement results are given in Table 5.

All of steel pipes Nos. 36 to 43, which were examples of the present invention, had a tensile strength not lower than 600 MPa, and also had high HIC resistance and HAZ toughness. The microstructure of steel pipe was substantially a ferrite phase, in which fine carbides with a particle diameter smaller than 10 nm which contained at least one element selected from Ti, Mo, and Nb and V were dispersed.

For steel pipes Nos. 44 to 48, which were comparative examples, the manufacturing method thereof was outside the range of the present invention, and for steel pipes Nos. 49 to 51, the chemical composition thereof was outside the range of the present invention. Therefore, for these steel pipes, the microstructure thereof was not substantially a ferrite phase, and fine carbides containing at least one element selected from Ti, Mo, and Nb and V were not precipitated, so that there caused a problem in that a sufficient strength was not obtained and cracking occurred in the HIC test.

Even if heat treatment was accomplished by either the induction heating apparatus or the gas-fired furnace, no difference in result was recognized.

TABLE 4

| Steel type | C | Si | Mn | P | S | Mo | Ti | Nb | V | Al | Cu | Ni | Cr | Ca | W | Ceq | C/(Mo + Ti + Nb + V + Zr)* | Remarks |
|---|---|---|---|---|---|---|---|---|---|---|---|---|---|---|---|---|---|---|
| a | 0.050 | 0.19 | 1.23 | 0.006 | 0.0010 | 0.14 | 0.018 | 0.014 | 0.046 | 0.028 | | | | | | 0.29 | 1.44 | Example |
| b | 0.042 | 0.21 | 1.30 | 0.008 | 0.0005 | 0.20 | 0.035 | 0.035 | | 0.032 | | | | | | 0.30 | 1.10 | |
| c | 0.039 | 0.26 | 1.45 | 0.010 | 0.0008 | 0.16 | 0.019 | 0.049 | 0.051 | 0.035 | | | | 0.0025 | | 0.32 | 0.90 | |
| d | 0.052 | 0.27 | 1.55 | 0.010 | 0.0010 | 0.22 | 0.038 | 0.027 | 0.042 | 0.036 | | | | | 0.21 | 0.36 | 0.81 | |
| e | 0.063 | 0.32 | 1.31 | 0.002 | 0.0008 | 0.37 | 0.028 | 0.024 | 0.045 | 0.026 | | | | 0.0021 | | 0.36 | 0.94 | |
| f | 0.045 | 0.21 | 1.26 | 0.008 | 0.0006 | 0.24 | 0.012 | 0.035 | 0.030 | 0.033 | 0.16 | 0.12 | | 0.0024 | | 0.33 | 1.01 | |
| g | 0.045 | 0.24 | 1.19 | 0.006 | 0.0009 | 0.06 | 0.081 | 0.024 | | 0.027 | | | | | | 0.26 | 1.46 | Comparative example |
| h | 0.055 | 0.16 | 1.28 | 0.007 | 0.0006 | 0.15 | 0.002 | 0.023 | 0.045 | 0.035 | | | | 0.0022 | | 0.31 | 1.67 | |
| i | 0.049 | 0.33 | 1.21 | 0.009 | 0.0015 | 0.02 | 0.018 | 0.015 | | 0.026 | | | | | | 0.25 | 5.47 | |

Unit: mass %, *: at %

Underline indicates outside the range of this invention

TABLE 5

| No. | Steel type | Outside diameter (mm) | Wall thickness (mm) | Heating temp. (° C.) | Rolling finish temp. (° C.) | Cooling rate (° C./s) | Cooling stop temp. (° C.) | Reheating | | |
|---|---|---|---|---|---|---|---|---|---|---|
| | | | | | | | | Method | Max. temp. Tmax (° C.) | Min. temp. Tmin (° C.) |
| 36 | a | 914.4 | 19.1 | 1200 | 880 | 30 | 580 | Induction heating furnace | 650 | 600 |

TABLE 5-continued

| | | | | | | | | | | |
|---|---|---|---|---|---|---|---|---|---|---|
| 37 | b | 914.4 | 19.1 | 1150 | 920 | 30 | 640 | Gas-fired furnace | 660 | — |
| 38 | b | 914.4 | 19.1 | 1200 | 900 | 30 | 590 | Induction heating furnace | 630 | 580 |
| 39 | c | 1219.2 | 25.4 | 1150 | 850 | 22 | 570 | Induction heating furnace | 650 | 630 |
| 40 | c | 1219.2 | 25.4 | 1150 | 930 | 22 | 680 | Induction heating furnace | 680 | 620 |
| 41 | d | 914.4 | 19.1 | 1200 | 920 | 30 | 600 | Gas-fired furnace | 650 | — |
| 42 | e | 914.4 | 19.1 | 1200 | 880 | 30 | 620 | Induction heating furnace | 630 | 600 |
| 43 | f | 914.4 | 19.1 | 1100 | 900 | 30 | 630 | Gas-fired furnace | 650 | — |
| 44 | b | 914.4 | 19.1 | 1200 | 850 | 1 | 660 | Induction heating furnace | 620 | 570 |
| 45 | b | 914.4 | 19.1 | 1200 | 850 | 30 | 750 | Gas-fired furnace | 660 | — |
| 46 | c | 1219.2 | 25.4 | 1200 | 900 | 55 | 580 | Gas-fired furnace | 580 | — |
| 47 | c | 1219.2 | 25.4 | 1200 | 900 | 55 | 650 | Gas-fired furnace | 750 | — |
| 48 | c | 1219.2 | 25.4 | 1100 | 900 | 60 | 400 | Induction heating furnace | 460 | 420 |
| 49 | g | 914.4 | 19.1 | 1150 | 850 | 45 | 650 | Induction heating furnace | 650 | 600 |
| 50 | h | 914.4 | 19.1 | 1150 | 850 | 45 | 650 | Induction heating furnace | 650 | 600 |
| 51 | i | 914.4 | 19.1 | 1150 | 850 | 45 | 650 | Gas-fired furnace | 650 | — |

| | Reheating | | | | | | Toughness | |
|---|---|---|---|---|---|---|---|---|
| No. | Time (min) | No. of cycles (cycle) | Yield strength (MPa) | Tensile strength (MPa) | Grade | HIC resistance | of welded part vTrs (° C.) | Remarks |
| 36 | 4.2 | 3 | 502 | 597 | X70 | ○ | −65 | Example |
| 37 | 7.3 | 1 | 532 | 654 | X70 | ○ | −43 | |
| 38 | 5.5 | 4 | 515 | 633 | X70 | ○ | −48 | |
| 39 | 3.2 | 2 | 508 | 612 | X70 | ○ | −57 | |
| 40 | 9.2 | 5 | 528 | 646 | X70 | ○ | −60 | |
| 41 | 6.0 | 1 | 604 | 731 | X80 | ○ | −42 | |
| 42 | 5.1 | 3 | 648 | 795 | X80 | ○ | −44 | |
| 43 | 4.5 | 1 | 545 | 655 | X70 | ○ | −70 | |
| 44 | 4.2 | 3 | 451 | 548 | X60 | ○ | −40 | Comparative example |
| 45 | 3.3 | 1 | 417 | 526 | X60 | ○ | −44 | |
| 46 | 1.5 | 1 | 427 | 518 | X60 | X | −56 | |
| 47 | 6.1 | 1 | 411 | 497 | X52 | ○ | −61 | |
| 48 | — | 2 | 488 | 583 | X65 | X | −55 | |
| 49 | 4.3 | 2 | 634 | 742 | X80 | ○ | 18 | |
| 50 | 9.1 | 4 | 425 | 513 | X60 | ○ | −89 | |
| 51 | 14.5 | 1 | 418 | 501 | X52 | ○ | −58 | |

Underline indicates outside the range of this invention

What is claimed is:

1. A high-strength steel pipe having sour resistance and a strength of API X65 grade or higher consisting essentially of, by mass %, 0.032 to 0.08% of C, 0.01 to 0.5% of Si, 0.5 to 1.8% of Mn, 0.01% or less of P, 0.002% or less of S, 0.01 to 0.07% of Al, 0.005 to 0.04% of Ti, 0.05 to 0.50% Mo, at least one element selected from the group consisting of 0.005 to 0.05% of Nb and 0.005 to 0.10% of V, optionally at least one element selected from the group consisting of Ca, Cu, Ni, W and Cr, and the balance being Fe, in which the volume percentage of a ferritic phase is 90% or higher, and complex carbides containing Ti, Mo, and at least one element selected from the group consisting of Nb and V are precipitated in said ferritic phase, said carbides having a fine size of 10 nm or smaller, and wherein Ceq is not higher than 0.34 where Ceq is defined as follows:

$$Ceq=C+Mn/6+(Cu+Ni)/15+(Cr+Mo+V)/5,$$

wherein a ratio R of the content in mass % of C to the total content in mass % of Mo, Ti, Nb, V and W, expressed as $R=(C/12)/[(Mo/96)+(Ti/48)+(Nb/93)+(V/51)+(W/184)]$, is 0.7 to 2.0.

2. The high-strength steel pipe having a strength of API X65 grade or higher according to claim 1, wherein the Ti is in an amount of 0.005 to less than 0.02 mass %.

3. A high-strength steel pipe having sour resistance and a strength of API X65 grade or higher consisting essentially of, by mass %, 0.032 to 0.08% of C, 0.01 to 0.5% of Si, 0.5 to 1.8% of Mn, 0.01% or less of P, 0.002% or less of S, 0.01 to 0.07% of Al, 0.005 to 0.04% of Ti, at least one element selected from the group consisting of 0.005 to 0.05% of Nb and 0.005 to 0.10% of V, W and Mo, and meeting the condition that the content of (W/2+Mo) is 0.05 to 0.50%, wherein the content of Mo can be 0%, optionally at least one element selected from the group consisting of Ca, Cu, Ni and Cr and the balance being Fe, in which the volume percentage of a ferritic phase is 90% or higher, and complex carbides containing Ti, W, Mo, and at least one element selected from the group consisting of Nb and V are precipitated in said ferritic phase, said carbides having a fine size of 10 nm or smaller, and wherein Ceq is not higher than 0.34 where Ceq is defined as follows:

$$Ceq=C+Mn/6+(Cu+Ni)/15+(Cr+Mo+V)/5,$$

wherein a ratio R of the content of C in mass % to the total content in mass % of Mo, Ti, Nb, V and W, expressed as $R=(C/12)/[(Mo/96)+(Ti/48)+(Nb/93)+(V/51)+(W/184)]$, is 0.7 to 2.0.

4. The high-strength steel pipe having a strength of API X65 grade or higher according to claim 3, wherein the Ti is in an amount of 0.005 to less than 0.02 mass %.

5. The high-strength steel pipe having a strength of API X65 grade or higher according to claim 1, wherein said steel pipe further contains 0.0005 to 0.0040 mass % of Ca.

6. The high-strength steel pipe having a strength of API X65 or higher according to claim 3, wherein said steel pipe further contains 0.0005 to 0.0040 mass % of Ca.

7. The high-strength steel pipe having a strength of API X65 or higher according to claim 1, wherein said steel pipe further contains at least one element selected from the group consisting of 0.5% or less of Cu, 0.5% or less of Cr, and 0.5% or less of Ni, by mass %.

8. The high-strength steel pipe having a strength of API X65 grade or higher according to claim 3, wherein said steel pipe further contains at least one element from the group consisting of 0.5% or less of Cu, 0.5% or less of Cr, and 0.5% or less of Ni, by mass %.

* * * * *